US006082155A

United States Patent [19]

Su

[11] Patent Number: 6,082,155

[45] Date of Patent: Jul. 4, 2000

[54] PAD LOCKS WITH CHANGEABLE CODE NUMBER

[76] Inventor: Shun-Chang Su, No. 11, Ping Ho Road, Lu Gang Cheng, Chang Hua Hsien, Taiwan

[21] Appl. No.: 09/165,555

[22] Filed: Oct. 2, 1998

[51] Int. Cl.[7] ..... E05B 37/06

[52] U.S. Cl. ..... 70/22; 70/28; 70/312

[58] Field of Search ..... 70/22, 24, 27–29, 70/308, 311, 312, 314–319

[56] References Cited

U.S. PATENT DOCUMENTS

| | | | |
|---|---|---|---|
| 4,341,101 | 7/1982 | Bako | 70/318 X |
| 4,343,164 | 8/1982 | Bako | 70/318 X |
| 4,520,641 | 6/1985 | Bako | 70/314 X |
| 4,711,108 | 12/1987 | Garro | 70/312 |
| 4,803,856 | 2/1989 | Ling | 70/28 |
| 4,831,860 | 5/1989 | Sheiman et al. | 70/316 X |
| 4,860,561 | 8/1989 | Hwang | 70/28 |
| 4,866,959 | 9/1989 | Ling | 70/312 X |
| 4,970,881 | 11/1990 | Hsiao | 70/312 X |
| 5,042,277 | 8/1991 | Jenn-Rong | 70/28 |
| 5,193,367 | 3/1993 | Ling | 70/312 X |
| 5,359,867 | 11/1994 | Ling et al. | 70/28 |
| 5,396,785 | 3/1995 | Chen | 70/312 X |
| 5,609,048 | 3/1997 | Ling | 70/28 |

*Primary Examiner*—Suzanne Dino Barrett
*Attorney, Agent, or Firm*—Charles E. Baxley

[57] ABSTRACT

A pad lock includes a casing including a hook extended outwards therefrom and several number wheels rotatably mounted in the casing. Each number wheel is partially exposed outside the casing for manual turning. Each number wheel includes a code wheel releasably engaged thereto to rotate therewith. A locking device is mounted in the casing and movable between a first position that retains the code wheels in place to allow free rotational movements of the number wheels for code number changing and a second position that disengages from the code wheels such that each code wheel is engaged with an associated number wheel to rotate therewith. An unlocking device includes a pivotal end pivotally mounted in the casing, a press end located outside the casing for manual pressing, an actuating end located in the casing and engaged with the locking device to move therewith, and a latch end located outside the casing and releasably engaged with the hook. A code-changing button has an outer end outside the casing for manual pressing and an inner end releasably engaged with the locking device to retain the locking device in the first position. The code-changing button is retained in a position that engages with and thus retains the locking device in the first position.

1 Claim, 8 Drawing Sheets

PAD LOCKS WITH CHANGEABLE CODE NUMBER

BACKGROUND OF THE INVENTION

1. Field of the Invention

The present invention relates to improved pad locks in which the code number thereof can be changed under simple operation.

2. Description of the Related Art

A pad lock of the type having several number wheels is changeable in the code number thereof. Conventionally, the user has to hold a sharp stick or the like by one hand and extend the sharp stick into a hole of the case to allow a change of the code number by the other hand. This is extremely inconvenient, as both hands are required while changing the code number. In addition, holding of the sharp stick is troublesome, An improved pad lock has been proposed to allow the user to continuously press a retaining member by one hand to allow a change of the code number by the other hand, yet such changing still requires both hands. The present invention is intended to provide improved pad locks to solve this problem.

SUMMARY OF THE INVENTION

It is a primary object of the present invention to provide an improved pad lock with a code-changing button that can be pressed and retained in place to allow a change of the code number by one hand.

In accordance with the present invention, a pad lock comprises:

a casing including a hook extended outwards therefrom, a plurality of number wheels rotatably mounted in the casing, each said number wheel being partially exposed outside the casing for manual turning, each said number wheel including a code wheel releasably engaged thereto to rotate therewith, a locking means mounted in the casing and movable between a first position that retains the code wheels in place to allow free rotational movements of the number wheels for code number changing and a second position that disengages from the code wheels such that each said code wheel is engaged with an associated said number wheel to rotate therewith, an unlocking member including a pivotal end pivotally mounted in the casing, a press end located outside the casing for manual pressing, an actuating end located in the casing and engaged with the locking means to move therewith, and a latch end located outside the casing and releasably engaged with the hook, a code-changing button having an outer end outside the casing for manual pressing and an inner end releasably engaged with the locking means to retain the locking means in the first position, and means for retaining the code-changing button in a position that engages with and thus retains the locking means in the first position.

In a preferred embodiment of the invention, the locking means includes an enlarged head and a stern extending from the enlarged head and having a first end adjacent to the enlarged head and a second end distal to the enlarged head. The stem includes a longitudinal groove defined in a periphery thereof and a plurality of annular grooves defined in the periphery thereof and adjacent to the second end thereof. Each code wheel is a sleeve that includes a protrusion formed on an inner periphery thereof. The stem is extended through the code wheels and the number wheels in a manner that the protrusion of each code wheel is received in an associated annular groove and not received in the longitudinal groove when the number wheels are not in a position that matches a correct code number such that the locking means is retained in the second position and not movable along a longitudinal direction. When the number wheels are rotated to the position that matches the correct code number, the protrusion of each code wheel is moved into the longitudinal groove such that the locking means is longitudinally movable from the second position to the first position upon a press on the press end of the unlocking member.

The casing may further comprise a plate mounted therein. The plate includes a plurality of elastic protrusions formed therein. Each elastic protrusion is engaged with an associated number wheel such that the associated number wheel is only rotatably in a single direction.

Each code wheel further includes a key formed on an outer periphery, and each number wheel includes an engaging groove defined in an inner periphery thereof for releasably engaging with the key on an associated code wheel. When the locking means is in the second position while the code-changing button is pressed, the key of each code wheel is disengaged from the engaging groove of an associated number wheel for code number changing.

The stem may further include a spring mounted around the first end thereof The spring has a first end attached to the enlarged head of the locking means and a second end attached to one of the code wheels for returning the code wheels to a position engaged with the number wheels when the code-changing button is pressed again.

The code-changing button includes a receptacle defined in a side thereof. The retaining means further includes a catch mounted in the casing and having a knurl and a spring. When the locking means is in the first position while the code-changing button is pressed, the receptacle is moved to a position in alignment with the knurl. In this case, the spring moves the catch toward the code-changing button and makes the knurl to be received in the receptacle to thereby retain the code-changing button in place.

In another preferred embodiment of the invention, the unlocking means includes:

a latch lever pivotally mounted in the casing and including the actuating end located in the casing and engaged with the locking means to move therewith and the latch end located outside the casing and releasably engaged with the hook, and an unlocking member including the pivotal end pivotally mounted in the casing, the press end outside the casing for manual pressing, and the end engaged with the actuating end of the latch lever to move therewith.

Each code wheel includes a notch defined in a periphery thereof and the locking means includes a plurality of protrusions. Each protrusion is engaged with the notch of an associated code wheel when the locking means is in the first position while the code-changing button is pushed to thereby retain the locking means in the first position.

The casing includes a plurality of axle rods each for rotatably mounting an associated number wheel and the associated code wheel. Each axle rod further includes a spring mounted therearound for biasing the associated code wheel toward the associated number wheel to rotate therewith.

The casing includes a wall formed on an inner periphery thereof The code-changing button includes a slot therein for receiving the wall. A spring is received in the slot and has a first end attached to the wall and a second end attached to an end wall that defines the slot. The locking means includes an engaging element, and the code-changing button further includes an arcuate protrusion formed on an outer periphery thereof for releasably engaging with the engaging element of the locking means. The locking means includes an engaging chamber that aligns with the arcuate protrusion when the locking means is in the first position.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
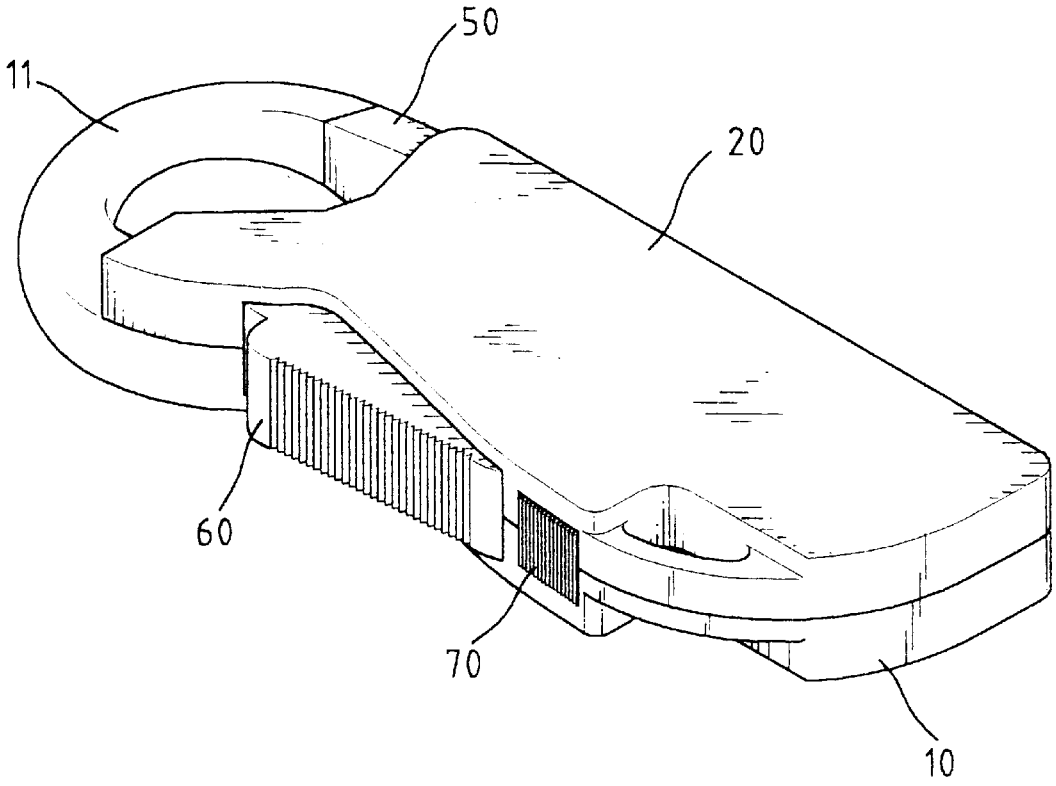
FIG. 1 is a perspective view of a first embodiment of a pad lock in accordance with the present invention.
Figure 2A:
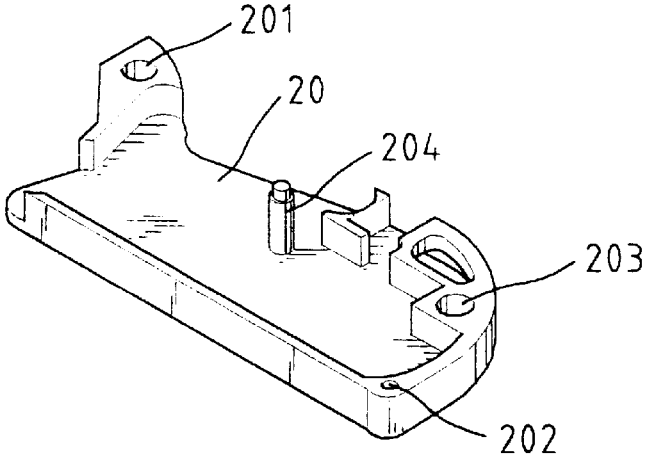
FIG. 2A is a perspective view illustrating an underside of an upper casing of the pad lock in FIG. 2.
Figure 2:
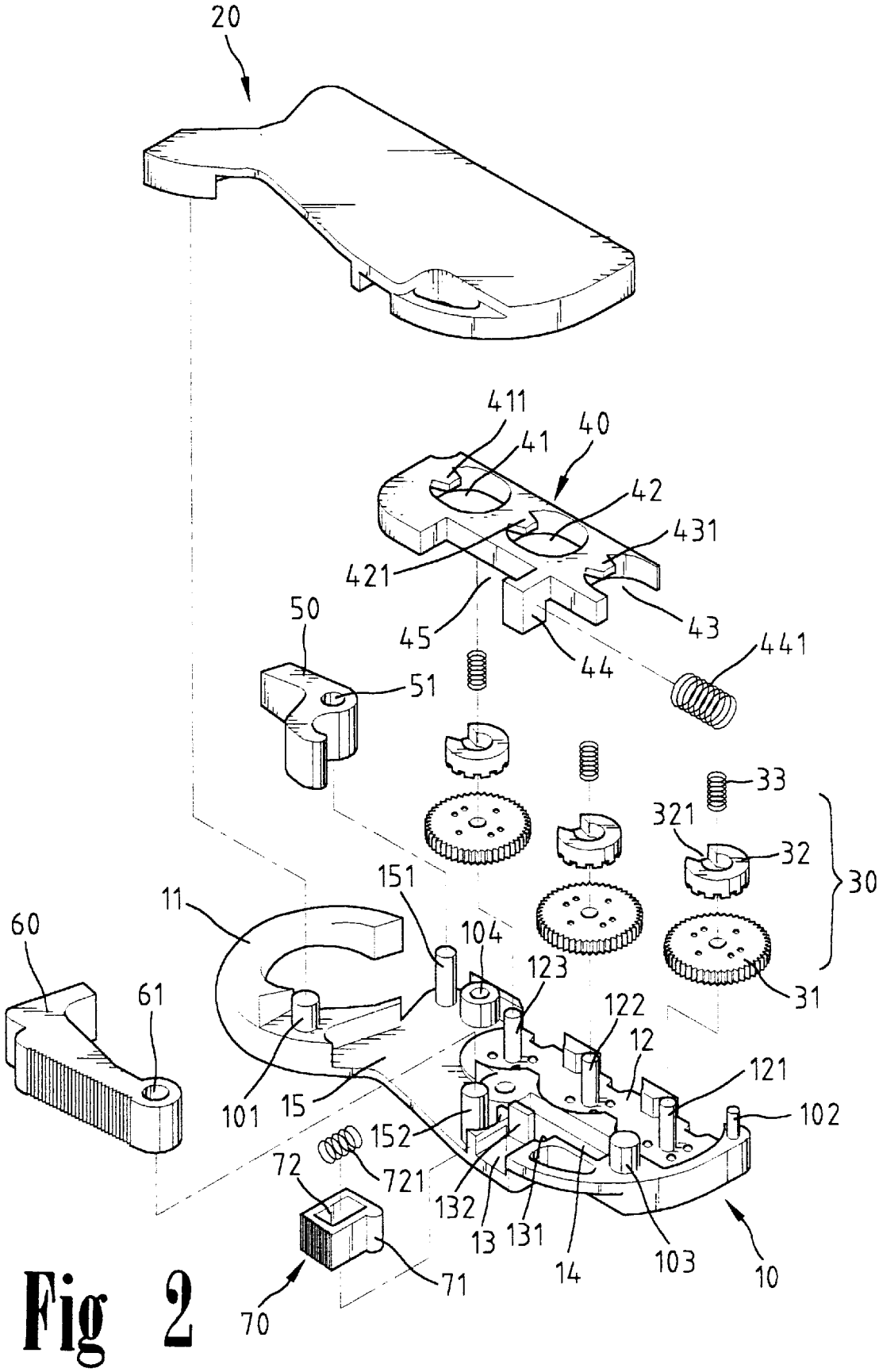
FIG. 2 is an exploded perspective view of the pad lock in FIG. 1.

Referring to the drawings and initially to FIGS. 1 and 2, a pad lock in accordance with the present invention generally includes a lower casing 10, a number wheel assembly 30, a locking plate 40, a latch lever 50, an unlocking member 60, a code-changing button 70, and an upper casing 20. The lower casing 10 includes a number of pegs 101, 102, 103 and a holed peg 104 formed on an upper side thereof for engaging with a number of receptacles 201, 202, 203 and a peg 204 (FIG. 2A) formed on an underside of the upper casing 20. The lower casing further includes a hook 11 formed on an end thereof and not covered by the upper casing 20. The upper side of the lower casing 10 further includes a first recessed section 12 formed thereon. A number of axle rods 121, 122, and 123 are formed on the first recessed section 12. Each axle rod 121, 122, 123 has a number wheel 31 and a code wheel 32 rotatably mounted thereon and a spring 33 mounted therearound, each code wheel 32 having a notch 321 defined in a periphery thereof; which will be described later.

The upper side of the lower casing 10 further includes a compartment 13 with an arcuate extension 131. A wall 132 is formed on the upper side of the lower casing 10 and located inside the compartment 13. The code-changing button 70 is partially, slidably received in the compartment 13 and has s slot 72 defined therein for receiving the wall 132 and a spring 721 that has a first end attached to the wall 132 and a second end attached to an end wall that defines the slot 72. The code-changing button 70 further includes an arcuate protrusion 71 received in the arcuate extension 131 of the compartment 13 to prevent from disengaging of the code-changing button 70. A recess 14 is defined between the wall 132 and the first recessed section 12, which will be described later.

The upper side of the lower casing 10 further includes a second recessed section 15 that has two spaced axle rods 151, 152 formed thereon. The latch lever 50 includes a hole 51 at a mediate section thereof for receiving the axle rod 151 to allow pivotal movement of the latch lever 50. The unlocking member 60 includes a hole 61 defined in an end thereof for receiving the axle rod 152 to allow pivotal movement of the unlocking member 60.

The locking plate 40 is mounted between the upper and lower casings 20 and 10 and includes two holes 41 and 42 and a notch 43. Each hole 41, 42 has a lug 411, 421 projecting from a periphery thereof, while the notch 43 has a lug 431 projecting from an arcuate wall thereof The locking plate 40 further includes an engaging element 44 formed on a lateral side thereof and movable in the recess 14 of the lower casing 10. A retaining chamber 45 is defined in the locking plate 40 for releasably retaining the code-changing button 70.

Figure 3:
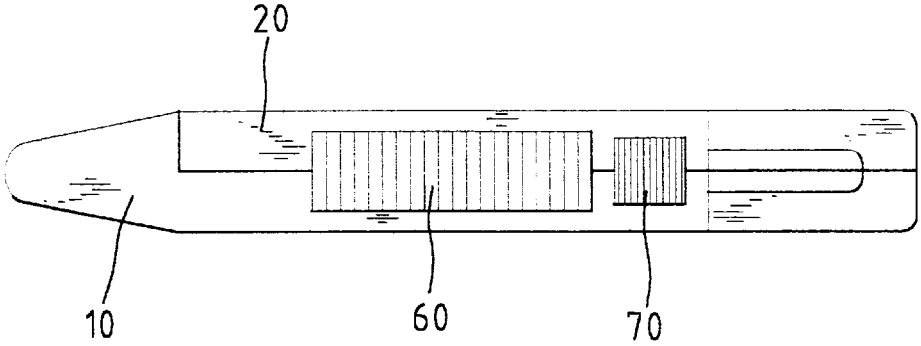
FIG. 3 is a view of the pad lock in FIG. 1.
Figure 4:
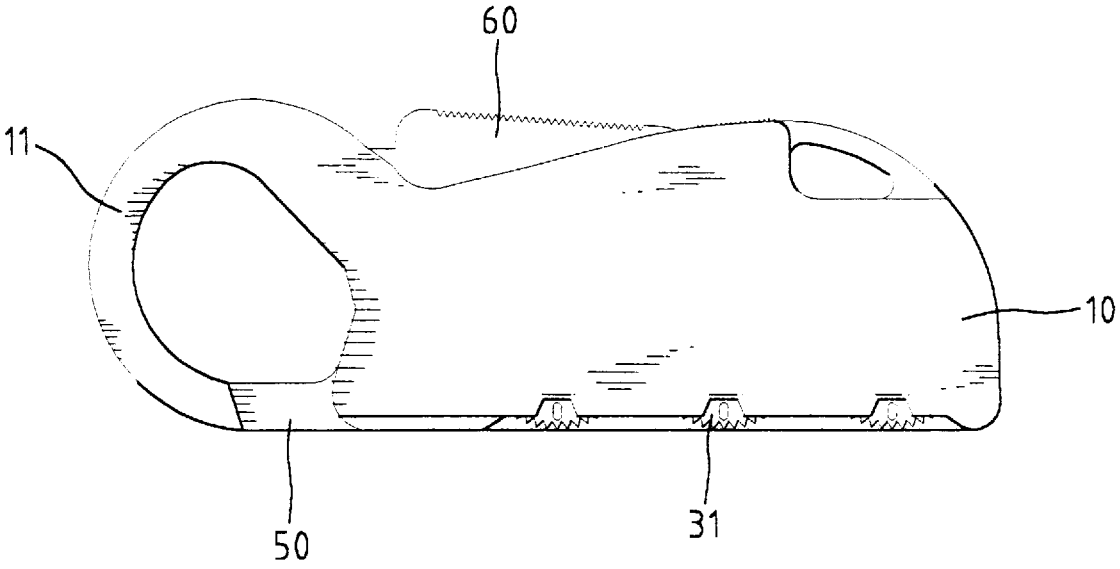
FIG. 4 is a top view, in an upside-down status, of the pad lock in FIG. 1.

FIG. 3 illustrates a front view of the assembled pad lock of the present invention, while FIG. 4 illustrates a top view of the pad lock.

Figure 5:
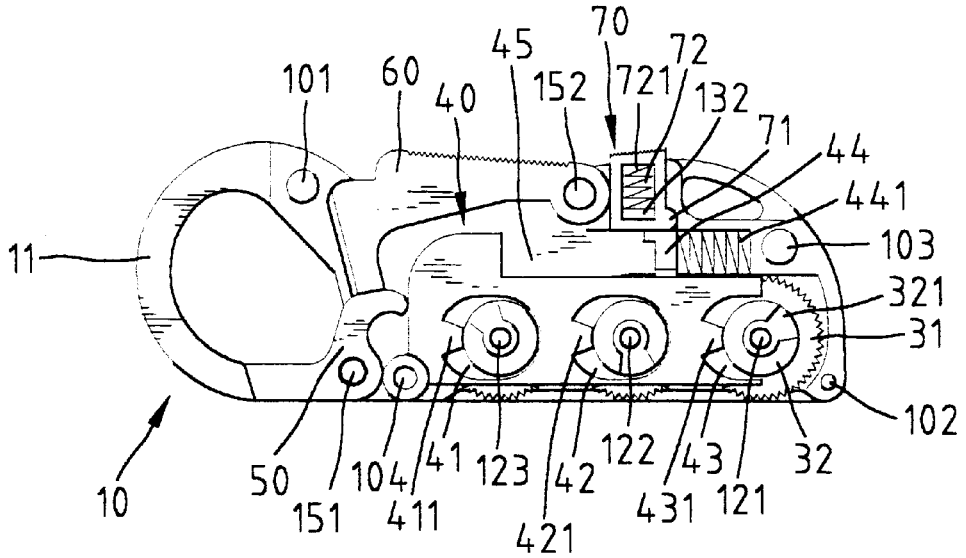
FIG. 5 is a top view similar to FIG. 4, with the upper casing removed to illustrate the inner structure, in which the number wheels of the pad lock are in a locked position.
Figure 6:
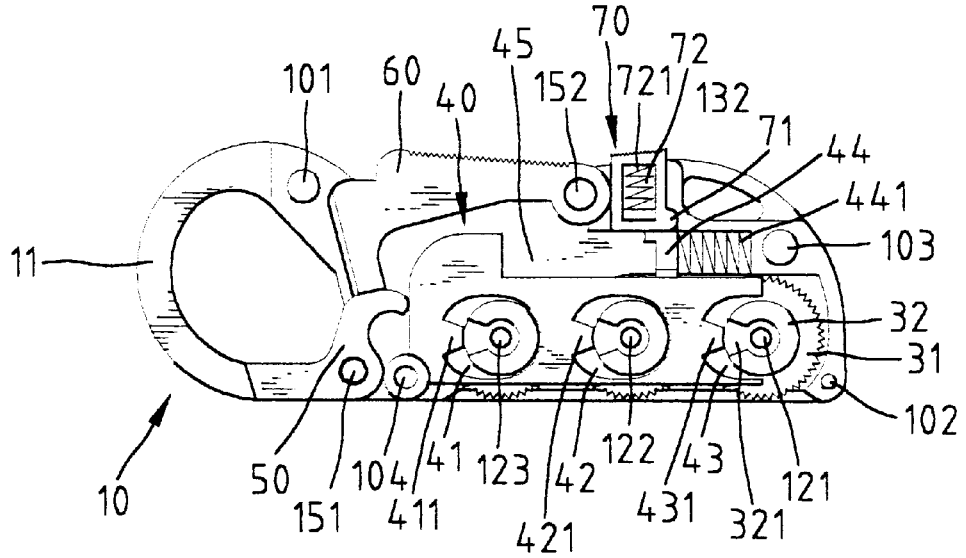
FIG. 6 is a top view similar to FIG. 5, in which the number wheels of the pad lock are in an unlocked position.

Referring to FIG. 5, when at least one of the notches 321 is not aligned with the associated lug 411, 421, 431, a second end of the unlocking member 60 that is distal to the first pivoted end (see 152) cannot be pressed, as at least one of the lugs 411, 421, and 431 are stopped by the code wheels 32 such that the locking plate 40 cannot be moved rightwards for unlocking. Referring to FIG. 6, after turning the number wheels 31 to the correct angular positions (the code number is matched), each notch 321 faces the associated lug 411, 421, 431. The unlocking member 60 can be pressed at the second end to actuate an actuating end of the latch lever 50 that engages with the second end of the unlocking member 60. The latch lever 50 pivots about the axle rod 151, wherein the actuating end of the latch lever 50 moves the locking plate 40 rightwards and thus makes the lugs 411, 421, and 431 to be received in the notches 32, while a latch end of the latch lever 50 is disengaged from the hook 11, best shown in FIG. 7. Thus, the pad lock is in an unlocked status.

Figure 7:
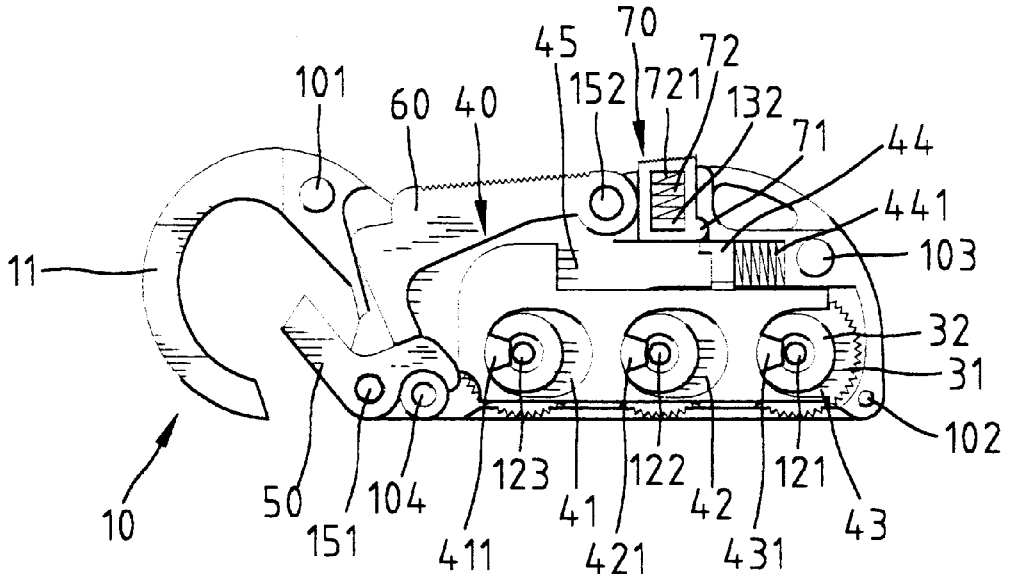
FIG. 7 is a top view similar to FIG. 6, illustrating unlocking of the pad lock.
Figure 8:
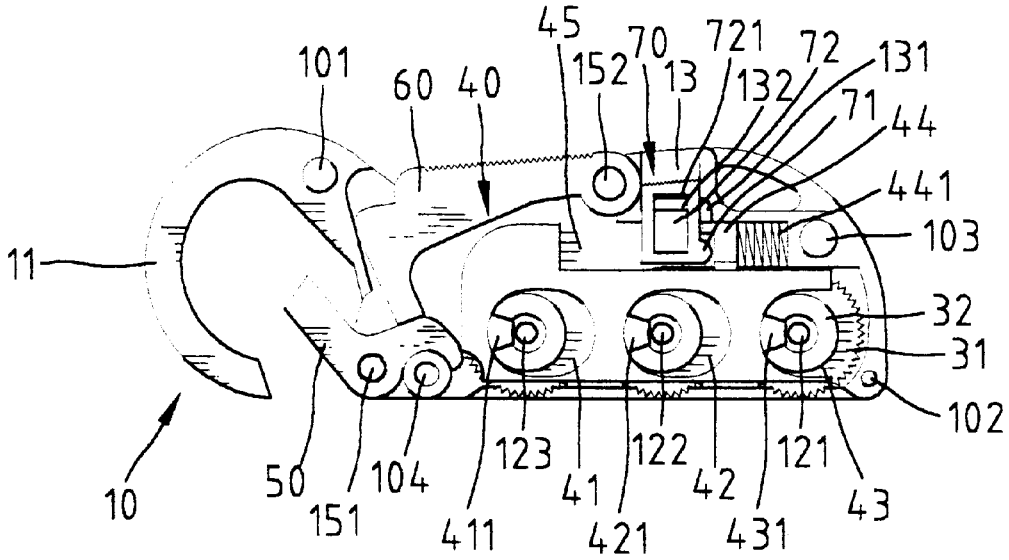
FIG. 8 is a top view similar to FIG. 7, illustrating code changing of the pad lock.

Under the unlocked status shown in FIG. 7, the code-changing button 70 aligns with the engaging chamber 45 of the locking plate 40. The user may push the code-changing button 70 to make the arcuate protrusion 71 engage with the engaging chamber 45 and thus retained in place by the engaging element 44, as shown in FIG. 8. The user may turn the number wheels 31 and thus change the code number as the code wheels 32 are retained in place by means of engagement between the notches 321 and the lugs 411, 421, and 431. The code changing procedure can be accomplished by a single hand. When the code-changing button 70 is pressed again, the spring 721 returns the code-changing button 70 to a position shown in FIG. 7 to allow normal operation of the pad lock. Thus, the code number changing operation is easy when compared to the prior art pad locks.

Figure 9:
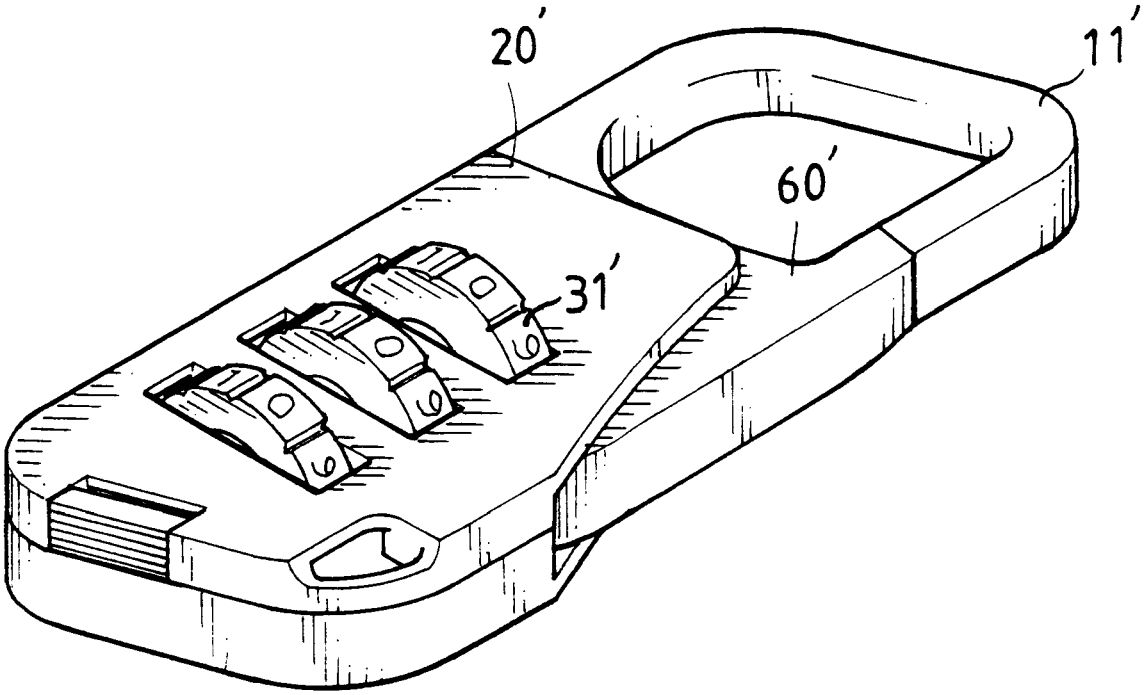
FIG. 9 is a perspective view of a second embodiment of the pad lock in accordance with the present invention.
Figure 10:
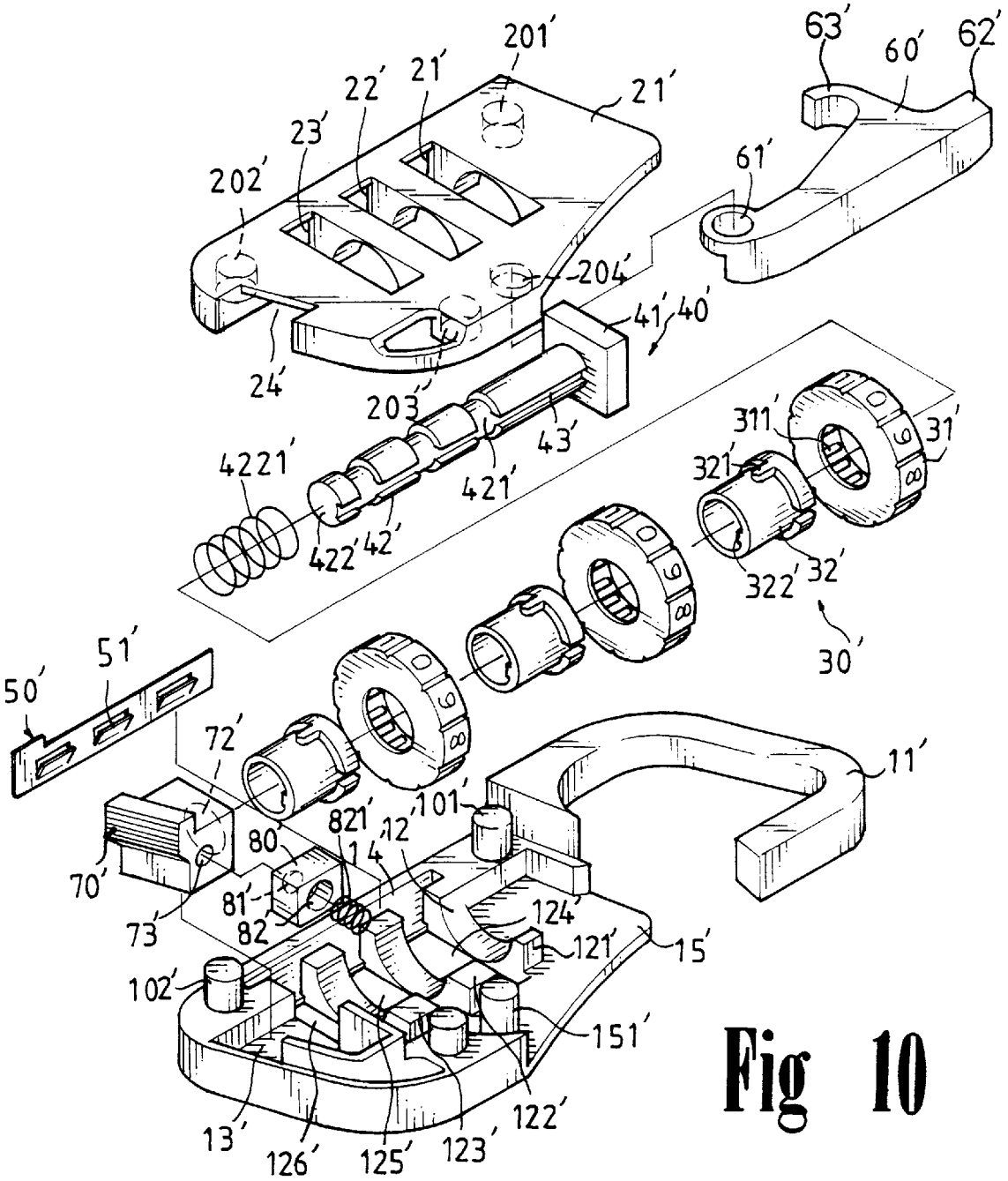
FIG. 10 is an exploded perspective view of the pad lock in FIG. 9.

FIGS. 9 and 10 illustrate a second embodiment of pad lock in accordance with the present invention. The pad lock includes a lower casing 10', a number wheel assembly 30', a locking means 40', an elastic plate 50', an unlocking member 60', a code-changing button 70', and an upper casing 20'. The lower casing 10' includes a number of pegs 101', 102', and 103' formed on an upper side thereof for engaging with a number of receptacles 201', 202', and 203' formed on an underside of the upper casing 20'. The lower casing 10' further includes a hook 11' formed on an end thereof and not covered by the upper casing 20'. The upper side of the lower casing 10' further includes a first recessed section 12' formed thereon. A number of U-shaped seats 121', 122', and 123' are formed on the first recessed section 12' to thereby define a plurality of number wheel compartments 124', 125', and 126' therebetween for receiving with the number wheel assembly 30'.

The upper side of the lower casing 10' further includes a substantially trapezoid compartment 13'. The code-changing button 70' is partially, slidably received in the compartment 13' and has a press end 71' exposed outside the upper and lower casings 20' and 10' for manual operation. The code-changing button 70' includes a longitudinal receptacle 72' defined therein and a transverse hole 73' extended in a lateral side and communicated with the longitudinal receptacle 72'. A catch 80' is received in the compartment 13' and includes a knurl 81' releasably engaged with the button 70'. The catch 80' further includes a receptacle 82' defined therein for partially receiving a spring 821' for returning the catch 80', which will be described later. A further compartment 14' is defined between an outer peripheral wall of the lower casing 10' and the first recessed section 12' for receiving an elastic plate 50' with a number of elastic protrusion 51', which will be described later.

The upper side of the lower casing 10' further includes a second recessed section 15' that has an axle rod 151' formed thereon. The unlocking member 60' includes a hole 61' defined in an end thereof for receiving the axle rod 151' to allow pivotal movement of the unlocking member 60'. The unlocking member 60' further includes a latch end 62' that may either cooperate with the hook 11' to form a closed space when in a locked position or move to an unlocked position that is disengaged with the hook 11'. The unlocking member 60' firer includes an actuating end 63', which will be described later.

The number wheel assembly 30' includes a plurality of number wheels 31' rotatably received in the number wheel compartments 124', 125', and 126' respectively. Each number wheel 31' is mounted around a sleeve-like code wheel 32' that has a key 321' releasably engaged with an engaging groove 311' defined in an inner periphery of a central hole of the number wheel 31'. Each code wheel 32' includes a protrusion 322' formed on an inner periphery thereof Each elastic protrusion 51' on the plate 50' contacts with an outer periphery of an associated number wheel 31' in a manner that the number wheel 31' is only rotatable in a single direction.

The locking means 40' includes an enlarged head 41' engaged with the actuating end 63' of the unlocking member 60' and a stem 42' extending from the enlarged head 41'. The stem 42' includes a longitudinal groove 43' and a number of longitudinally spaced annular grooves 421' defined in an outer periphery of an end 423' distal to the enlarged head 41'. The other end 422' of the stem 42' has a spring 4221' mounted therearound and between the enlarged head 41' and an outermost code wheel 32' that is adjacent to the enlarged head 41'. The annular grooves 421' respectively receive the protrusions 322' of the code wheels 32', which will be described later. The upper casing 20' includes a number of slots 21', 22', and 23' arranged in a manner that a portion of each of the number wheels 31' is accessible via an associated slot 21', 22', 23' to allow manual rotation. The upper casing 20' further includes a recess 204' for receiving an upper end of the axle rod 151' to prevent from disengagement of the unlocking member 60' from the axle rod 151'. The upper casing 20' further includes a notch 24' through which the press end 71' of the code-changing button 70' is extended outside for manual pressing.

Figure 11:
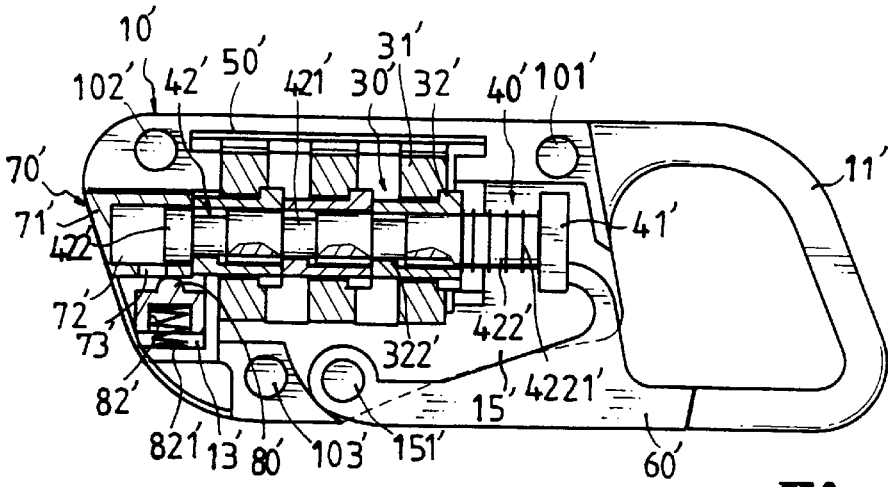
FIG. 11 is a top view, partly sectioned, of the pad lock in FIG. 9, in which the pad lock is in a locked status.

The number wheels 31' in FIG. 11 are not in the unlocked position, in which at least one of the protrusions 322' in the code wheels 32' is received in the annular grooves 421' but not in the longitudinal groove 431' such that the locking means 40' is not movable along a longitudinal direction thereof. As a result, the unlocking member 60' cannot be pressed for unlocking.

Figure 12:
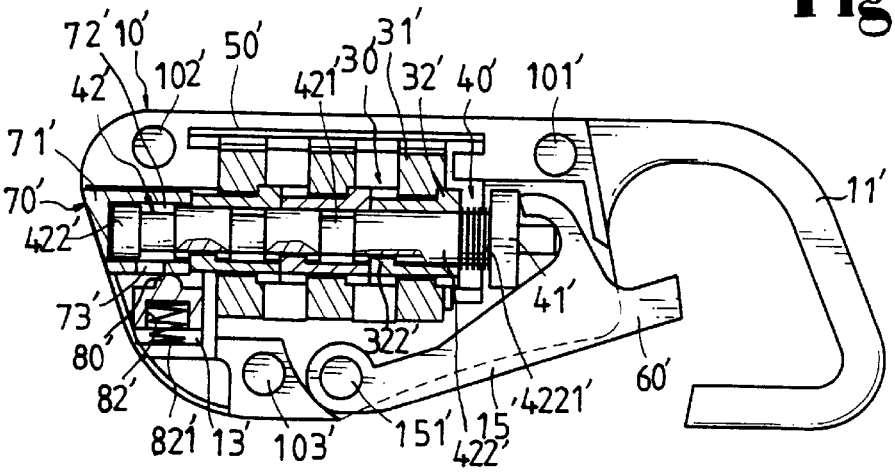
FIG. 12 is a top view similar to FIG. 11, in which the pad lock is in an unlocked status.
Figure 13:
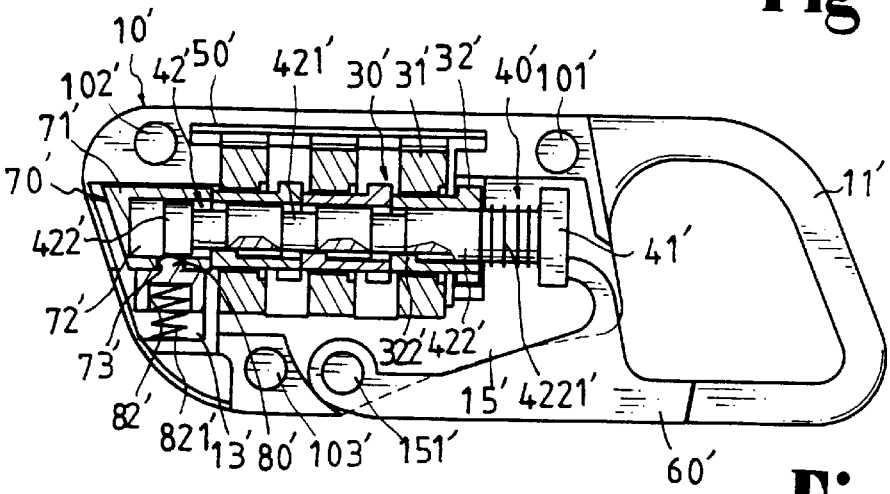
FIG. 13 is a top view similar to FIG. 11, in which the pad lock is in a status that allows code number changing.

Referring to FIG. 12, if the number wheels 31 are rotated to a position that matches the correct code number the protrusion 322' of each code wheel 32' is rotated to an intersection of the associated annular groove 421' and the longitudinal groove 431'. Thus, the locking means 40' is movable along its longitudinal direction and thus allows pressing of the unlocking member 60'. It is appreciated that, upon pressing the unlocking member 60', the actuating end 63' of the unlocking member 60' makes the locking means 40' slide leftwards (see FIG. 12) while the latch end 62' of the unlocking member 60' disengages from the hook 11' to thereby achieve the unlocking purpose.

Still referring to FIG. 12, when code number changing is required, the user may push the code-changing button 70' and thus make the leftmost one of the code wheel 32' move rightwards. The receptacle 73' of the button 70' becomes in alignment with the knurl 81' of the catch 80' and thus receives the knurl 81' as the catch 80' is moved toward the button 70' under the action of the spring 821'. As a result, the button 70' is retained in place. The key 321' on each code wheel 32' that is originally received in engaging groove 311' of the associated number wheel 31' disengages from the engaging groove 311', as the code wheels 32' are moved longitudinally relative to the number wheels 31'. As a result, the number wheels 31' are freely rotatable without rotating the code wheels 32'. Namely, the user may turn the number wheels 31' and thus change the code number. Pressing the button 70' again may cause disengagement of the knurl 81' of the catch 80' from the receptacle 73' of the button 70' and thus allows returning of the button 70' and the code wheels 32'. Thus, the keys 321' of the code wheels 32' are returned to engage with the engaging grooves 311' of the number wheels 31' to move therewith. Accordingly, the code number changing procedure can be completed by a single hand, and the pad lock can be unlocked only when the number wheels 31' are rotated to a position that matches the correct code number.

Although the invention has been explained in relation to its preferred embodiment, it is to be understood that many other possible modifications and variations can be made without departing from the spirit and scope of the invention as hereinafter claimed.

What is claimed is:

1. A pad lock, comprising:

a casing including a hook extended outwards therefrom;

a plurality of number wheels rotatably mounted in the casing, each said number wheel being partially exposed outside the casing for manual turning, each said number wheel including a code wheel releasably engaged thereto to rotate therewith;

a locking means mounted in the casing and movable between a first position that retains the code wheels in place to allow free rotational movements of the number wheels for code number changing and a second position that disengages from the code wheels such that each said code wheel is engaged with an associated said number wheel to rotate therewith;

an unlocking means including a pivotal end pivotally mounted in the casing, a press end located outside the casing for manual pressing, an actuating end located in the casing and engaged with the locking means to move therewith, and a latch end located outside the casing and releasably engaged with the hook;

a code-changing button having an outer end outside the casing for manual pressing and an inner end releasably engaged with the locking means to retain the locking means in the first position, and;

means for retaining the code-changing button in a position that engages with and thus retains the locking means in the first position, wherein the locking means includes an enlarged head and a stem extending from the enlarged head and having a first end adjacent to the enlarged head and a second end distal to the enlarged head, the stem including a longitudinal groove defined in a periphery thereof and a plurality of annular grooves defined in the periphery thereof and adjacent to the second end thereof, each said code wheel being a sleeve that includes a protrusion formed on an inner periphery thereof, the stem being extended through the code wheels and the number wheels in a manner that the protrusion of each said code wheel is received in an associated said annular groove and not received in the longitudinal groove when the number wheels are not in a position that matches a correct code number such that the locking means is retained in the second position and not movable along a longitudinal direction, and wherein when the number wheels are rotated to the position that matches the correct code number, the protrusion of each said code wheel is moved into the longitudinal position to the first position upon a press on the press end of the unlocking member, wherein the code-changing button includes a receptacle defined in a side thereof, and the retaining means further includes a catch mounted in the casing and having a knurl and a spring, wherein the locking means is in the first position while the code-changing button is pressed, the receptacle is moved to a position in alignment with the knurl, and the spring moves the catch toward the code-changing button and makes the knurl be received in the receptacle to thereby retain the code-changing button in place.

* * * * *